US008142054B2

(12) United States Patent
Takahashi et al.

(10) Patent No.: US 8,142,054 B2
(45) Date of Patent: Mar. 27, 2012

(54) LIGHT-EMITTING APPARATUS HAVING A HEAT-RESISTANT GLASS SUBSTRATE SEPARATED THROUGH A VACUUM LAYER FROM A GLASS SUBSTRATE USED AS THE LIGHT PROJECTION PLANE

(75) Inventors: Hisaya Takahashi, Kanagawa (JP); Atsushi Namba, Tokyo (JP); Toshiya Arakawa, Tokyo (JP); Mikio Ono, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 254 days.

(21) Appl. No.: 12/250,249

(22) Filed: Oct. 13, 2008

(65) Prior Publication Data

US 2009/0097256 A1 Apr. 16, 2009

(30) Foreign Application Priority Data

Oct. 16, 2007 (JP) ..... 2007-269549

(51) Int. Cl.
*F21V 7/22* (2006.01)
*F21V 3/04* (2006.01)
*H01J 1/62* (2006.01)

(52) U.S. Cl. ..... 362/307; 362/310; 362/311.05; 313/495

(58) Field of Classification Search ..... 362/296.1, 362/262, 300, 307, 311.01, 311.05, 296.01, 362/310; 313/567, 495–497
See application file for complete search history.

(56) References Cited

U.S. PATENT DOCUMENTS 4,112,329 A * 9/1978 Veith ..... 313/491
4,972,116 A * 11/1990 Tatsuda et al. ..... 313/497
5,150,005 A * 9/1992 Yokono ..... 313/495
5,345,141 A * 9/1994 Moyer et al. ..... 313/495
5,440,200 A * 8/1995 Ozawa ..... 313/495
5,504,385 A * 4/1996 Jin et al. ..... 313/310
(Continued)

FOREIGN PATENT DOCUMENTS

JP 2006092967 4/2006
(Continued)

OTHER PUBLICATIONS

European Patent Office, European Search Report, European Patent Application No. 08166493, dated Feb. 22, 2010, 6 pages.

*Primary Examiner* — Alan Cariaso
(74) *Attorney, Agent, or Firm* — Haynes and Boone, LLP

(57) ABSTRACT

Provided herein is a light-emitting apparatus capable of achieving both improved durability and higher brightness with an inexpensive and simple construction. A heat resistant glass substrate 51 is mounted in a vacuum chamber 5, and while an anode electrode 8 (and a light emitter 20) is mounted on the glass substrate, the glass substrate 51 is separated from a glass substrate 11. This precisely protects the vacuum chamber 5 from thermal damage due to light emission upon excitation, even when the current density between the cathode electrode 6 and the anode electrode 8 is controlled at a high level to cause the light emitter 20 to emit light at high brightness. Accordingly, this eliminates the need to make the entire vacuum chamber 5 excessively heat-resistant, permitting construction from an inexpensive material such as soda-lime glass; consequently both improvements in the durability of the light-emitting apparatus 1 and enhancement in brightness thereof can be accomplished with an inexpensive and easy construction.

2 Claims, 9 Drawing Sheets

U.S. PATENT DOCUMENTS

| | | | | |
|---|---|---|---|---|
| 6,137,213 | A * | 10/2000 | Moyer et al. | 313/495 |
| 6,284,556 | B1 * | 9/2001 | Wang et al. | 438/20 |
| 6,596,141 | B2 * | 7/2003 | Rasmussen | 313/496 |
| 6,703,779 | B2 * | 3/2004 | Kawase | 313/495 |
| 7,462,979 | B2 * | 12/2008 | Konishi et al. | 313/497 |
| 2005/0156506 | A1 * | 7/2005 | Chung et al. | 313/495 |
| 2006/0214557 | A1 * | 9/2006 | Ohwada et al. | 313/495 |

FOREIGN PATENT DOCUMENTS

| | | | |
|---|---|---|---|
| JP | 2006-339012 | A | 12/2006 |
| WO | 2007078129 | A1 | 7/2007 |

* cited by examiner (a)

(b)

LIGHT-EMITTING APPARATUS HAVING A HEAT-RESISTANT GLASS SUBSTRATE SEPARATED THROUGH A VACUUM LAYER FROM A GLASS SUBSTRATE USED AS THE LIGHT PROJECTION PLANE

CROSS REFERENCE TO RELATED APPLICATIONS

This application claims priority under 35 U.S.C. 119 based upon Japanese Patent Application Serial No. 2007-269549, filed on Oct. 16, 2007. The entire disclosure of the aforesaid application is incorporated herein by reference.

FIELD OF THE INVENTION

The present invention relates to a light-emitting apparatus which causes a light emitter to emit light upon excitation by field-emitted electrons from a cold cathode electron emission

BACKGROUND OF THE INVENTION

In contrast to the conventional light emitting devices such as incandescent lamps or fluorescent lamps, cold cathode field emission type light emitting devices have recently been developed which call for electrons emitted in a vacuum from a cold cathode electron emission source to be thrown at high speed upon a light emitter, thereby exciting the light emitter to emit light, providing the anticipated prospect of its use for field emission lamps (FELs) or field emission display devices (FEDs).

Among these light emitting devices, in particular, FELs, which are specialized for use in lamp light sources and the like can be fabricated with a simple construction in which cathode electrodes, anode electrodes and the like are placed in a vacuum chamber having glass substrates mounted oppositely to each other, with a predetermined spacing. In this case, for example, as disclosed in Japanese Unexamined Patent Application Publication No. 2006-339012, the anode electrode is generally constructed by film-forming a transparent electrically conductive film such as ITO (indium-tin-oxide) or the like on the back side of a glass substrate which forms a light projecting plane on a vacuum chamber, and on a top layer of the anode electrode is film-formed a light emitter.

It is noted that vacuum chambers, in this type of light emitting devices, are fabricated via a vacuum sealing step at high temperature. Therefore, in order to prevent the generation of cracks and the like by thermal expansion during the vacuum sealing step and the like, generally the vacuum chambers are constructed through a combination of glass base materials with equal coefficients of linear expansion. In this case, although it is also possible to use quartz glass or the like as a glass base material, it is preferable to use soda-lime glass which is easy to process and moreover available at low cost in the market so as to hold down the manufacturing costs.

On the other hand, soda-lime glass or the like, lacking in heat resistance, tends to fracture with a local temperature rise due to thermal distortion. It is necessary herein to control the current density between the cathode and anode at a high level for a light emitter to emit high brightness light; however, as is well known, the higher the current density, the higher is the temperature of the light emitter. For example, the light emitter undergoes a temperature rise of about 30 degrees C. with an increase in the luminescence intensity by 0.1 W/cm$^2$. Therefore, light emitting devices in which the vacuum chamber is fabricated of soda-lime glass or the like have been limited in causing the light emitter to emit high brightness light.

The present invention has been made in view of the above-mentioned situation, and it is an object thereof to provide a light emitting device capable of providing both improved durability with an inexpensive and simple construction and higher brightness.

SUMMARY OF THE INVENTION

The present invention comprises a cathode electrode having a cold-cathode electron emission source and an anode electrode having a light emitter which emits light upon excitation by electrons field-emitted from said cold-cathode electron emission source, which are installed in a vacuum chamber, wherein a heat-resistant glass substrate is mounted, through a vacuum layer, oppositely to and on the interior side of a transparent base material which constitutes a light projection plane for said vacuum chamber and wherein said anode electrode is mounted on said glass substrate.

In accordance with the light-emitting apparatus of the present invention, both improved durability and higher brightness can be accomplished with an inexpensive and simple construction.

DETAILED DESCRIPTION OF THE INVENTION

Figure 1:
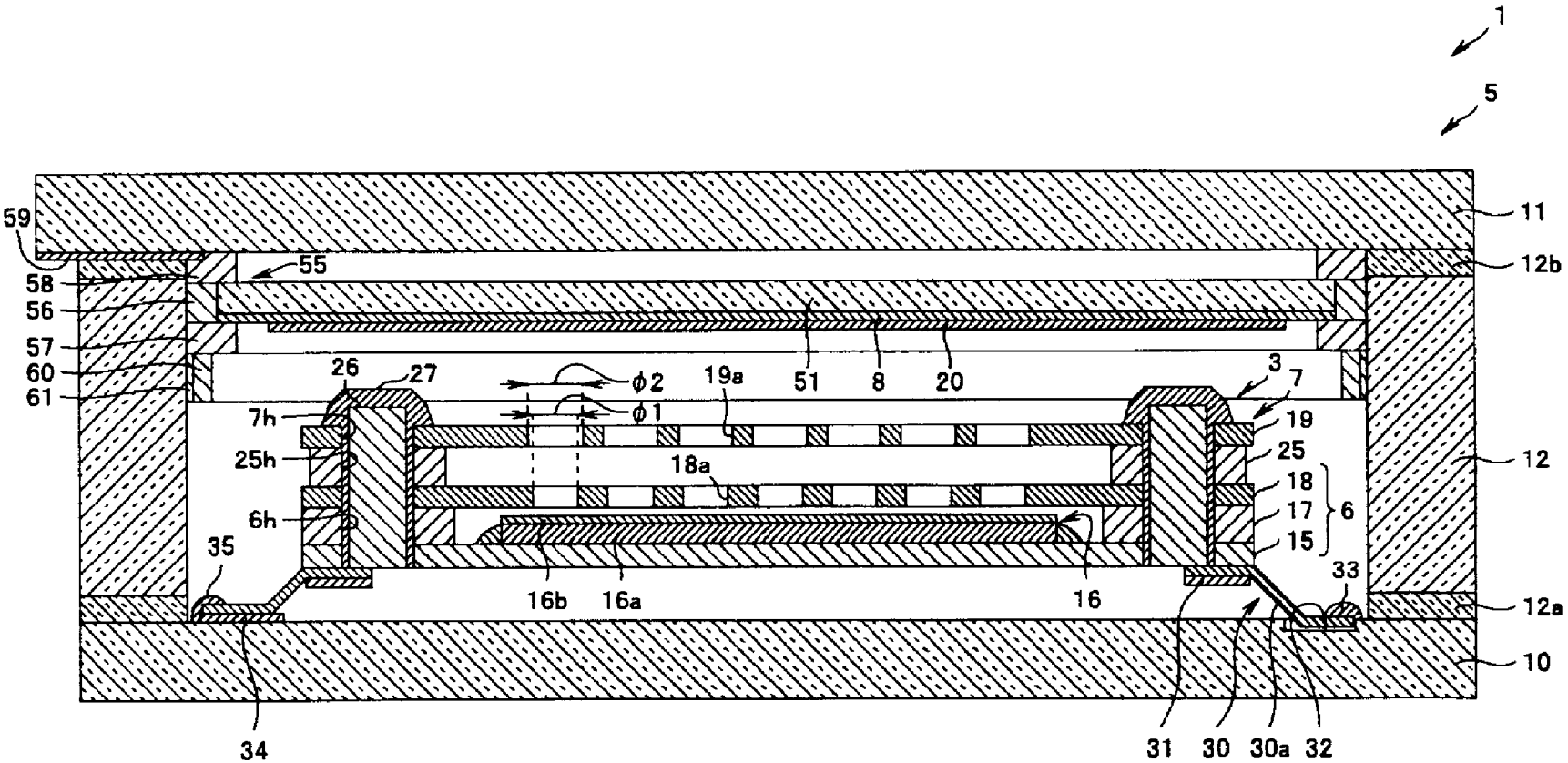
FIG. 1 is a cross-sectional view of the principal parts of a light-emitting apparatus related to a first embodiment of the present invention.
Figure 2:
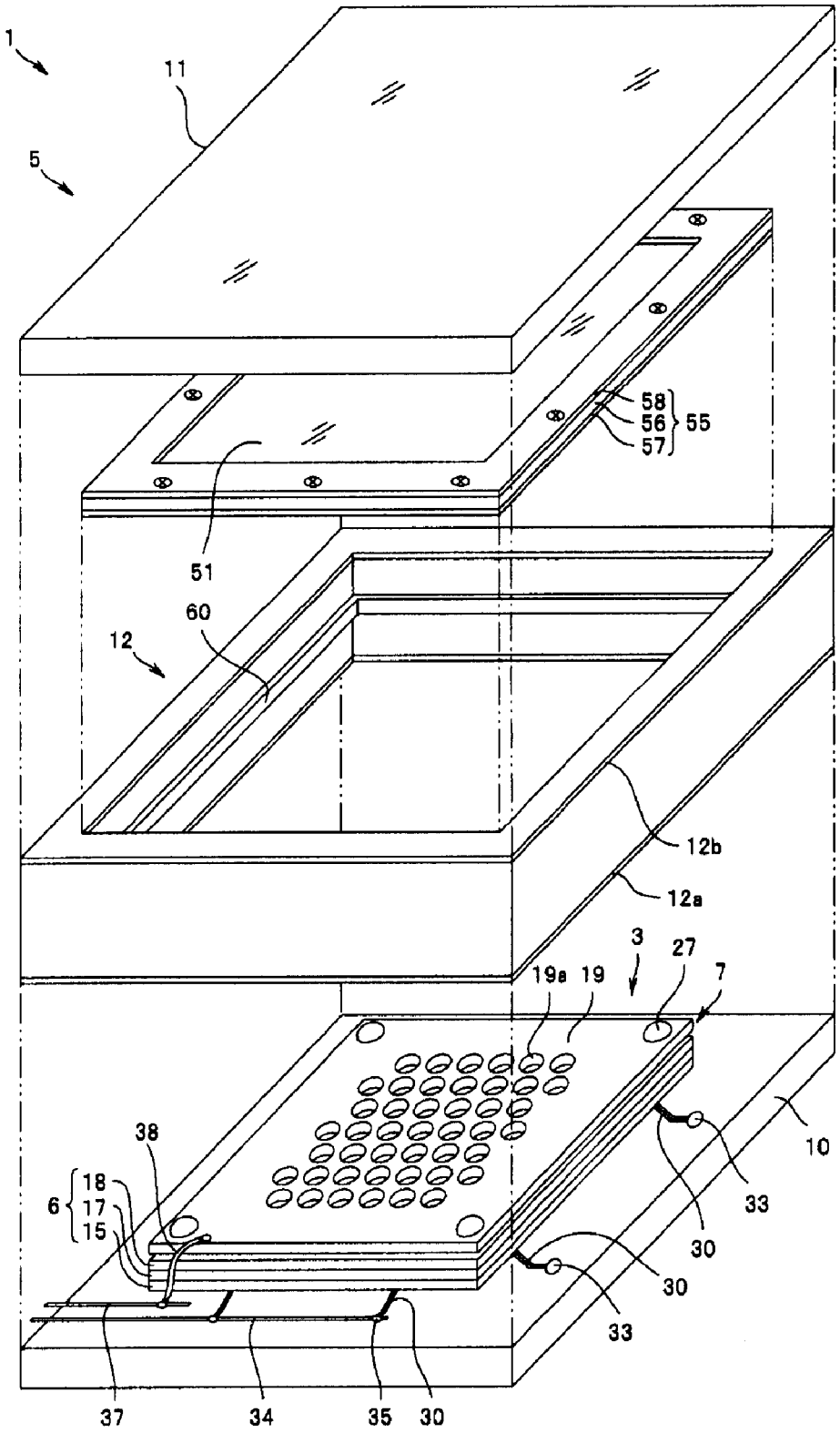
FIG. 2 is an exploded perspective view of a light-emitting apparatus related to the first embodiment of the present invention.
Figure 3:
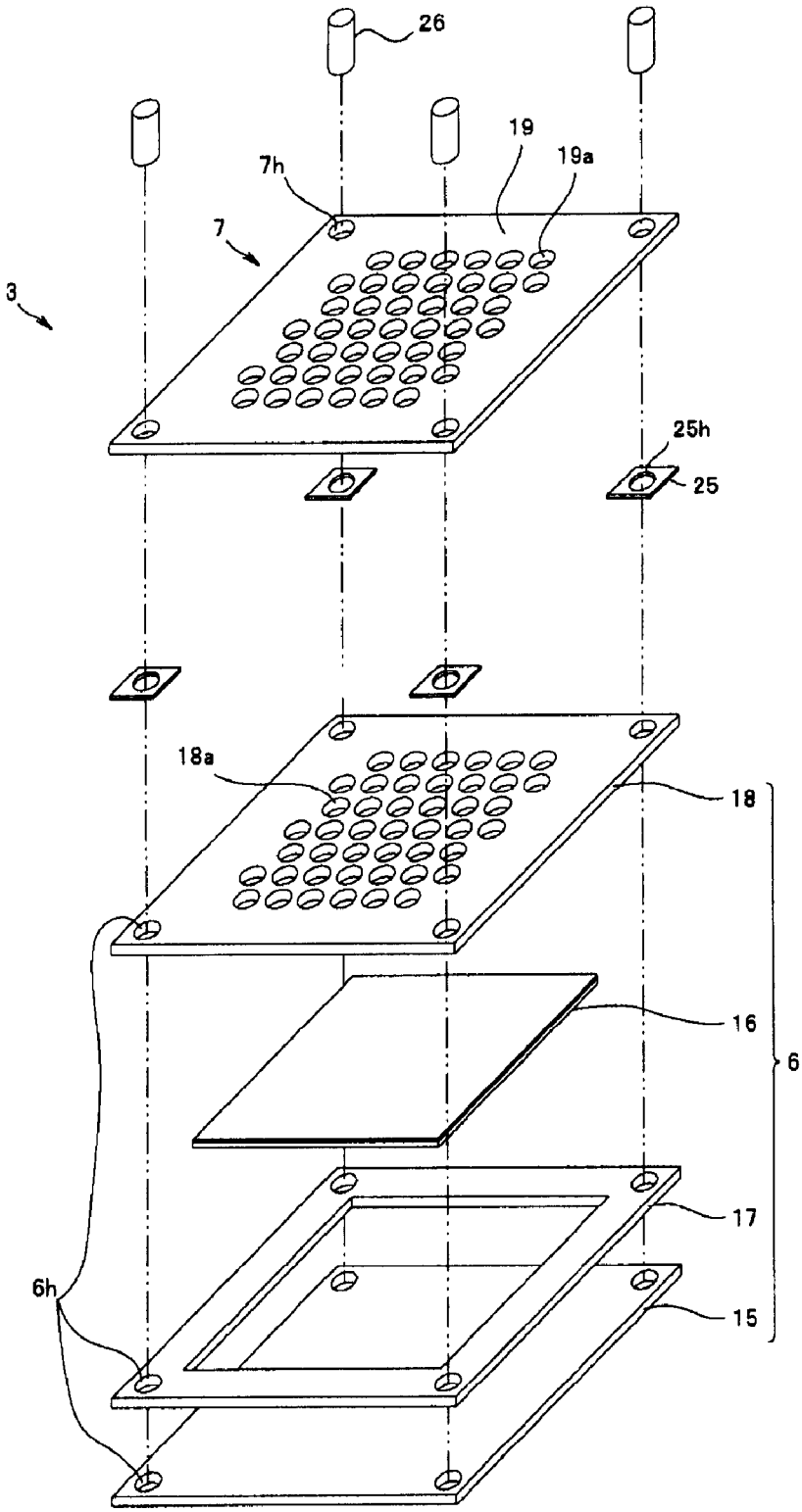
FIG. 3 is an exploded perspective view of an electrode unit related to the first embodiment of the present invention.
Figure 4A:
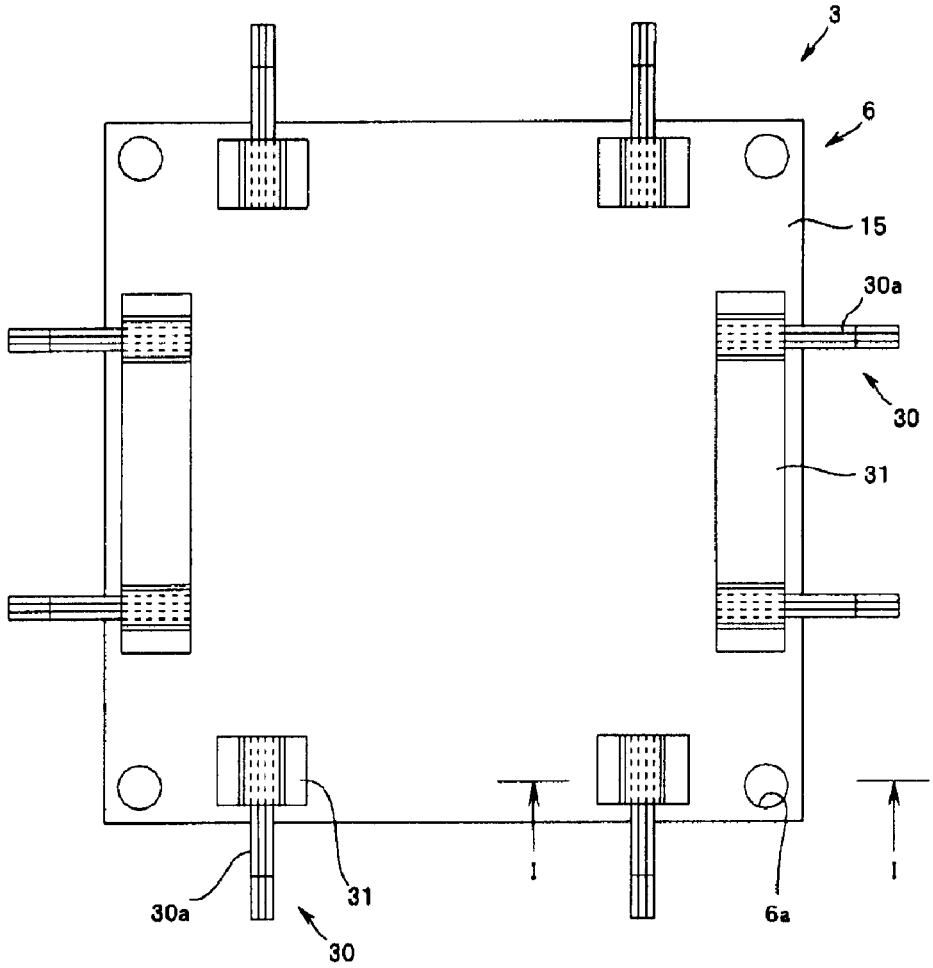
FIG. 4A is a bottom face view of an electrode unit; 4B is a cross-sectional view of the principal parts along Line I-I of 4A related to the first embodiment of the present invention.
Figure 4B:
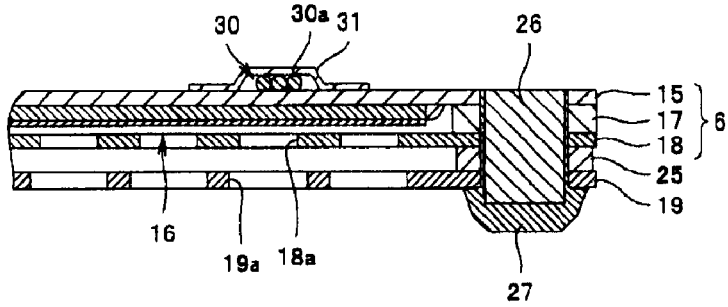
Figure 5:
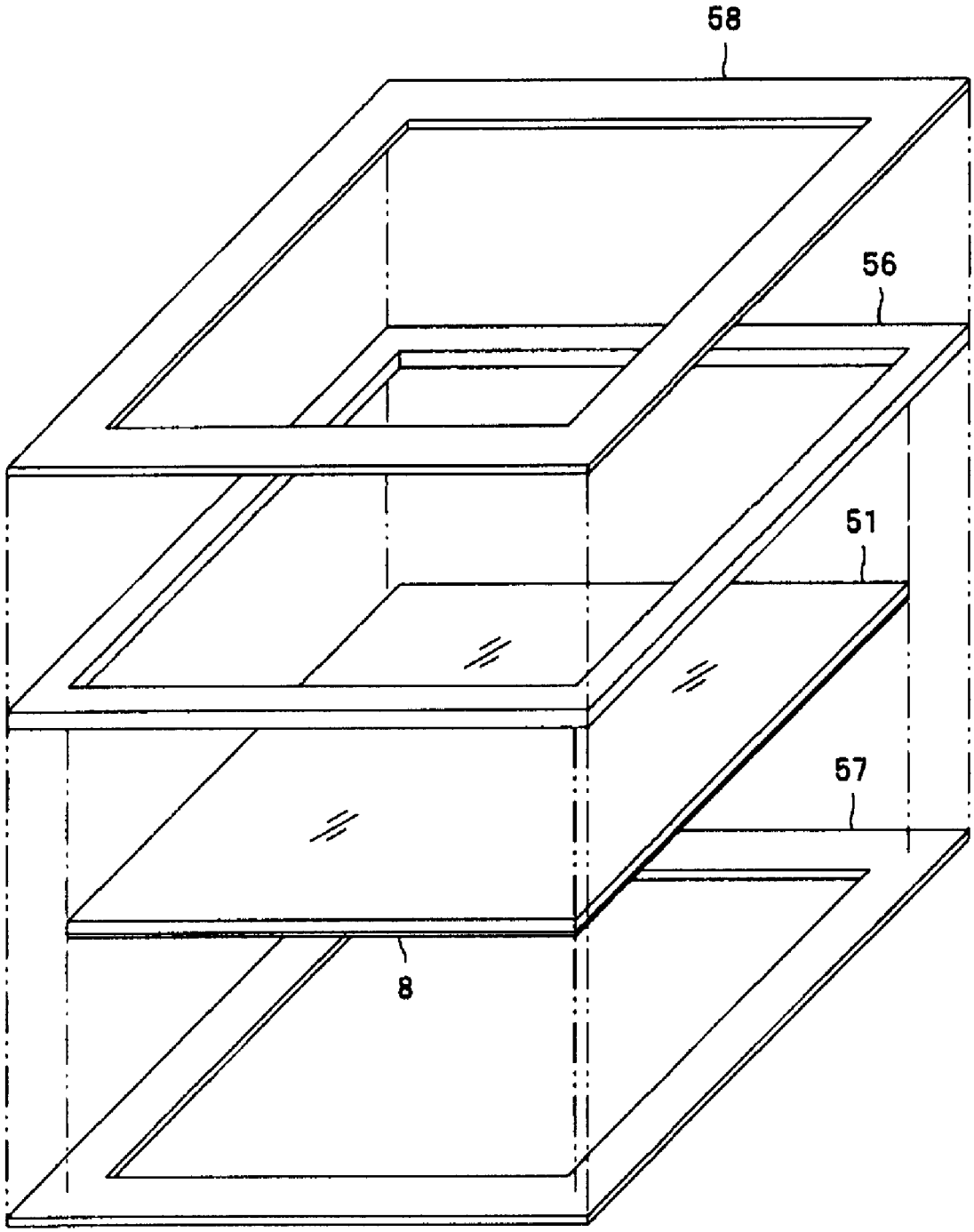
FIG. 5 is an exploded perspective view of a glass substrate and clamping fixture related to the first embodiment of the present invention.

Here in after, embodiments of the present invention are explained with reference to the accompanying drawings. FIGS. 1 to 5 are related to a first embodiment of the present invention: FIG. 1 is a cross-sectional view of the principal parts of a light-emitting apparatus; FIG. 2 is an exploded perspective view of a light-emitting apparatus; FIG. 3 is an exploded perspective view of an electrode unit; FIG. 4A is a bottom face view of an electrode unit; FIG. 4B is a cross-sectional view of the principal parts along Line I-I of 4A; and FIG. 5 is an exploded perspective view of a glass substrate and clamping fixture.

In FIG. 1, reference number 1 shows a light-emitting apparatus, and shows in the present embodiment a planar field emission type illumination lamp suitable as a light source, such as, for example, for vehicular head lamps, tail lamps, and the like.

The light-emitting apparatus 1 has a basic construction in which are installed in a vacuum chamber 5 held at high vacuum a cathode electrode 6, a gate electrode 7, and an anode electrode 8 in sequence from a bottom face side toward a light-projection plane side.

The vacuum chamber 5 is constituted of a jointly-assembled body, for example, of multiple glass members. Specifically, the vacuum chamber 5 comprises a pair of glass substrates 10 and 11 of a rectangular shape in plane view, which are mounted opposite to each other, at the base bottom face side and the light projection plane side, and a frame body 12 which is intervened between these glass substrates 10 and 11. The frame body 12 is made of glass members formed annularly along the edge side portions of both glass substrates 10 and 11; and on the frame body 12 at its contact faces with each of the glass substrates 10 and 11 are formed low melting point glass layers 12*a*, 12*b*, respectively which for example melt at 450 to 500 degrees C. Further, a vacuum chamber 5 with its interior section held at high vacuum is formed, for example, in a vacuum furnace held at high vacuum, by having the glass substrates 10 and 11 fused with the frame body 12 via the low melting point layers 12*a*, 12*b*. Incidentally, the glass substrates 10 and 11 and frame body 12 which constitute the vacuum chamber 5 are suitably constructed by processing soda-lime glass which is widely available at low cost in the market.

A cathode electrode 6, for principal parts thereof, is constructed by mounting a cold cathode electron emission source 16 on a flat plate base material 15 formed in a rectangular shape in a plane view. Furthermore, on the base material 15 is superposed an annular spacer 17 which surrounds the periphery of the cold cathode electron emission source 16; on the spacer 17 is superposed an emitter mask 18 that opposes the cold cathode electron emission source 16 with a predetermined minute separation therefrom.

Herein, it is preferable for the base material 15 to be composed of an electrically conductive material of a low coefficient of linear expansion, specifically to be composed preferably with a metal plate made of a stainless steel or INVAR (known generically as 64 FeNi) material. In the present embodiment, the base material 15 suitably uses, for example, a thin 42% nickel-iron sheet 0.2 mm in sheet thickness.

Moreover, the cold cathode electron emission source 16 is, for example, composed of a 0.5 mm thick N-type silicon substrate 16*a* with its surface having uniformly formed thereon an ND-CNW (nano diamond-carbon nano wall) layer 16*b*. Then, when the cold cathode electron emission source 16 is mounted on the base material 15, the back side of the N type silicon substrate 16*a* is electrically connected to the base material 15.

Moreover, the spacer 17 is, for example, composed of a 0.75 mm-thick thin sheet member made of the same type of electrically conductive material as that of base material 15 (for example, 42% nickel iron).

In addition, the emitter mask 18 is, for example, constructed of a 0.2 mm-thick thin sheet member made of the same type of electrically conductive material as that of the base material 15 and spacer 17 (for example, 42% nickel iron). The emitter mask 18 has multiple apertures 18*a* open for specifying the electron emission region on the cold cathode electron emission source 16. The emitter mask 18 is equipotential with the base material 15 by virtue of being electrically connected to the base material 15 via the spacer 17, thereby inhibiting the field emission of electrons, except to a region facing the apertures 18*a* on the cold cathode electron emission source 16. Therefore, this allows the cold cathode electron emission source 16 to specify only the region facing the apertures 18*a* of the emitter mask 18 as the region for the electron emission. In addition, in the present embodiment, the aperture dimension of the apertures 18*a* is set at a diameter $\phi 1$=1.6 mm; such relatively large diameter apertures 18*a* can be readily opened by etching or the like.

The gate electrode 7 has its principal parts, for example, constructed by having multiple apertures 19*a* opened corresponding to the emitter mask 18, on a flat plate shaped base material 19 which is made of the same type of electrically conductive material as that of the base material 15 or the like of the cathode electrode 6 and which is in a rectangular shape in the plane view. It is preferred for the apertures 19*a* of the gate electrode 7 to be set with diameters larger than those of apertures 18*a* of the emitter mask 18 in consideration of alignment errors or the like with the cathode electrode 6. In the present embodiment, the opening dimension of the aperture 19*a* is set at a diameter $\phi 2$=1.8 mm; such relatively large diameter apertures 19*a* can be readily opened by etching or the like.

Herein, the gate electrode 7 is held on the cathode electrode 6 thereby constituting an electrode unit 3 and is held integrated onto the glass substrate 10 via multiple legs 30 fixed onto the back side of the cathode electrode 6.

Specifically explained, there are, in the four corners of the cathode electrode 6, through-holes 6*h* opened which run through the base material 15, spacer 17, and emitter mask 18, respectively. Further, there are, in the four corners of the gate electrode 7, through-holes 7*h* opened which run through the base material 19 at positions corresponding to each of the through-holes 6*h* of the cathode electrode 6, respectively.

Moreover, there are mounted, in the four corners of the cathode electrode 6, between it and the gate electrode 7, spacers 25 having through-holes 25*h* corresponding to the through-holes 6*h* and 7*h*. These spacers 25 are, for example, made of an insulating ceramic member so as to prevent the cathode electrode 6 and the gate electrode 7 from electrically short-circuiting. In addition, the sheet thickness of these spacers 25 is set, for example, at 1.0 mm so as to set the opposing distance between the gate electrode 7 and the cathode equal to or higher than a prescribed lower limit. Note that the lower limit is a distance which makes it possible to prevent harmful metal sputtering from the gate electrode 7 to the cathode electrode 6, and at the same time it is a distance for preventing a substantial reduction of electrons emitted from the cold cathode electron emission source 16 due to the distance between the gate electrode 7 and cathode electrode 6 being too close to allow an effective generation of an electric field; it is set, for example, in a range of 0.1 to 0.5 mm.

Through-holes 6*h*, 25*h*, and 7*h* continuing through the four corners of the laminate body with the gate electrode 7 superposed on the cathode electrode 6 via spacers 25 in this manner, have pins 26 inserted therethrough and at the same time are filled with a ceramic based inorganic adhesive 27. Having the pins 26, by means of the inorganic adhesive 27, adhered to the interior periphery of each of the through-holes, 6*h*, 25*h*, and 7*h* of the cathode electrode 6, spacer 25, and the gate electrode 7 allows the gate electrode 7 to be held integrated with the cathode electrode 6, thereby constituting an electrode unit 3.

Here, the pins 26 are composed of insulating ceramic pins to prevent an electrical short circuiting between the cathode electrode 6 and the gate electrode 7.

The inorganic adhesive 27 is an adhesive suitably capable of bonding alumina, mica, soda-lime glass, nickel, nickel iron, stainless steel, and the like. As its required capability, it has a coefficient of linear expansion within a range of $5\times10^{-6}$ to $10\times10^{-6}$ (cm/cm/° C.), preferably in particular, within a range of $6.5\times10^{-6}$ to $8.5\times10^{-6}$ (cm/cm/° C.). Furthermore, it is preferred for its viscosity to be in a range of 10,000 to 80,000 (cps), in particular in a range of 30,000 to 40,000 (cps). It is suitable to use CERAMABOND for the inorganic adhesive 27.

As shown in FIG. 4, the electrode unit 3 has on each side of the back face of the cathode electrode 6, a pair of legs made of a flexible inorganic material firmly mounted thereon, respectively. Each leg 30 is constructed, for example, by spot-welding a group of 3 dumet wires 30*a* to the back face of the base material 15. Furthermore, for reinforcement, for example, a nickel ribbon 31 which covers each leg 30 is firmly mounted by spot welding or the like to the back face of the base material 15. In addition, in order to provide sufficient support strength while securing suitable flexibility in retaining the electrode unit 3 in the present embodiment, for each dumet wire 30*a*, one with a diameter $\phi$=0.3 mm is suitably used. Moreover, as for the nickel ribbon 31, one, for example, with a thickness t=0.2 mm and width w=3 mm is suitably used.

Separately, on the glass substrate 10, guide grooves 32 are each cut which extend along the direction in which each leg 30 extends, for example, at positions each corresponding to three pairs of legs 30, respectively, from among the respective pairs of legs 30 which are mounted at each side of the cathode electrode 6. The tip portion of each corresponding leg 30 is inserted into each guide groove 32, and is firmly bonded to the glass substrate 10 through a ceramic-based inorganic adhesive (for example, the above-mentioned CERAMABOND 33.

Moreover, on the glass substrate 10, a pattern wiring 34 which electrically connects within and without the vacuum chamber 5 is wired at a position corresponding to the remaining one pair of legs 30 out of those mounted on the cathode electrode 6. And respective legs 30 corresponding to the pattern wiring 34 are, at the tips thereof, electrically connected to the pattern wiring 34 through a silver paste and the like, and thereafter it is firmly bonded to the glass substrate 10 through a ceramic-based inorganic adhesive (for example, the above-mentioned CERAMABOND) 35.

The support structure, through these legs 30, allows the electrode unit 3 to be held flexibly with the glass substrate 10 at a predetermined separation therefrom. At the same time, at least one pair out of the respective legs 30 (one pair of legs 30 in the present embodiment) is electrically connected to the pattern wiring 34, thereby doubly serving a function as an electrically conductive line to the cathode electrode 6.

Note that as shown in FIG. 2, there is wired, near the pattern wiring 34 which is electrically connected to the cathode electrode 6, a pattern wiring 37 which electrically connects within and without the vacuum chamber 5; the gate electrode 7 is electrically connected to this pattern wiring 37 via an electrically conductive line 38.

The anode electrode 8 is provided on the glass substrate 51 installed in the vacuum chamber 5. This anode electrode 8 is made up of a transparent electrically conductive film (for example, ITO film) and is arranged on the glass substrate 51 oppositely to the gate electrode 7 (cathode electrode 6). Moreover, there is formed as a film a fluorescent material 20 which is excited by the electrons emitted from the cold cathode electron emission source 16. In addition, in order to simplify the manufacturing process, it is preferable to use a glass substrate 51 which has a preformed transparent electrically conductive film (for example, ITO film) thereon which is enabled to function on the glass substrate 51 as an anode electrode 8. Moreover, the fluorescent material 20 can be formed as a film on the anode electrode 8, for example, by a screen-printing method, ink-jet method, photography method, precipitation method, electrodeposition method, and the like.

The glass substrate 51 is made of a glass material which is heat resistant to a high temperature of 100 degrees C. or higher, and is mounted oppositely, through the vacuum layer, to the interior face of the glass substrate 11 that constitutes a light projection plane of the vacuum chamber 5. Herein, in the present embodiment, by the glass material which is heat resistant to 100 degrees C. or higher is meant a glass material which has durability (in other words having the characteristic of hardly undergoing a thermal distortion even when heated to 100 degrees C. or higher such that it suffers no cracks due to thermal distortion or the like when heated to 100 degrees C. or higher). For such a glass material 51, for example, it is suitably possible to use quartz glass.

As shown in FIG. 1, in the present embodiment, the glass substrate 51 is made of a flat plate member with a rectangular shape in a plane view opposing the entire aperture domain of apertures 19*a* (apertures 18*a*) on the gate electrode 7 (emitter mask 18) and is held in the vacuum chamber 5 via a clamping fixture 55 fixed to the periphery thereof.

As shown in FIG. 5, the clamping fixture 55 comprises a fixture body 56 approximately about the same plate thickness as the glass substrate 51, and spacers 57, and 58 which are superposed on both faces of this fixture body 56.

The fixture body 56 is made of an annular plate member the exterior periphery of which fits in with the interior periphery of the frame body 12, and holds in its interior periphery thereof the glass substrate 51 by having the glass substrate 51 fitted therein. The spacers 57 and 58 are, for example, made of an annular plate member having a plate thickness of several tenths of a mm to 1 mm, and are fixed to the fixture body 56, for example, by spot welding or the like (See FIG. 2). The interior peripheries of spacers 57 and 58 are set smaller than the interior periphery of the fixture body 56 (Refer to FIGS. 1 and 5); and when the spacers 57 and 58 are fixed to the fixture body 56, they come in contact with the edge side parts of the glass substrate 51, thereby preventing the glass substrate 51 from falling off the fixture body 56.

As shown in FIGS. 1 and 2, a ceramic retainer plate 60 is bonded to the interior face of the frame body 12 with an inorganic adhesive 61 such as CERAMABOND thereby sandwiching the clamping fixture 55 between this retainer plate 60 and glass substrate 11 for holding the glass substrate 51 in the vacuum chamber 5. In that case, the spacer 58 ends up being interposed between the glass substrates 11 and 51, thereby causing the glass substrate 51 to oppose the glass substrate 11 through a vacuum layer.

Here, it is desired for the clamping fixture 55 (fixture body 56 and spacers 57 and 58) to be made of an electrically conductive material having a low coefficient of linear expansion; specifically, it is preferred for it to be made of a stainless steel or INVAR metal plate. In the present embodiment, it is suitable for the fixture body 56 and spacers 57 and 58 to be made using a thin 42% nickel iron plate material. Having the clamping fixture 55 made of an electrically conductive material allows it to be electrically connected to the anode electrode 8. As shown in FIG. 1, there is wired a pattern wiring 59 which electrically connects within and without the vacuum chamber 5, where the spacer 58 coming into contact with the pattern wiring 59 allows the clamping fixture 55 to also function as a conductive member for electrically connecting the anode electrode 8 to the pattern wiring 59.

In accordance with such embodiment, individual construction of the cathode electrode 6 and the gate electrode 7 from functional plate-shaped parts, respectively, permits these to be inexpensively manufactured without resorting to a micro process and the like. It is by means of opening through-holes 6*h* and 7*h* respectively which mutually oppose these cathode electrode 6 and the gate electrode 7, inserting pins 26 which run through these through-holes 6*h* and 7*h*, and bonding the inserted pins to the cathode electrode 6 and the gate electrode 7 with a ceramic-based inorganic adhesive 27 that even when a stress or the like acts against the cathode electrode 6 and the gate electrode 7 in the plane directions thereof, these relative distortions or the like can be suppressed by means of the pins 26 whereby the bonding state of the two electrodes 6 and 7 can be precisely maintained. Further, the use of a ceramic-based adhesive 27 for bonding the pins 26 to both electrodes 6 and 7 and the like can precisely prevent organic contamination in the vacuum chamber 5.

Distortion due to thermal deformation of both the electrodes 6 and 7 can be suppressed in this case by adopting the same type of an INVAR material (particularly 43% nickel) of a low coefficient of linear expansion as the base materials 15 and 19 and the like for the cathode electrode 6 and the gate electrode 7. Furthermore, the use, as inorganic adhesive 27, of CERAMABOND which has a coefficient of linear expansion close to that of INVAR material and high affinity therewith enables the state of bonding of the both the electrodes 6 and 7 to be kept more suitable than would be otherwise.

Moreover, it is by fixing multiple legs 30 made of a flexible inorganic material to the cathode electrode 6 unitized with the gate electrode 7 and holding the cathode electrode 6 via the legs 30 that even when there is generated a relative distortion between the vacuum chamber 5 (glass substrate 10, etc.) and the electrode units (cathode electrode 6, etc.), this distortion can be absorbed by the legs 30, thereby allowing the electrode unit 30 to be precisely held in the vacuum chamber 5. Accordingly, inexpensive soda-lime glass or the like can be used for the glass substrate 10 or the like of the vacuum chamber 5 so that a greater cost reduction of the light emitting device 1 can be achieved.

In this case, the electrode unit 3 can be more reliably held in the vacuum chamber 5 with a simple construction by providing the vacuum chamber 5 (glass substrate 10) with guide grooves 32 corresponding to the legs 30 and firmly bonding the tip parts of the legs 30 within the guide grooves 32 to the glass substrate 10 by way of an inorganic adhesive 33. Further, even if the adhesion of the inorganic adhesive 33 for the leg 30 were to ever fail, the electrode unit 3 would be precisely held onto the glass substrate 10 by slightly sliding the legs 30 over within the guide grooves 32 filled with the inorganic adhesive 33.

In addition, if the retaining structure of the leg 30 by means of the guide grooves 32 is replaced by bonding of the legs 30 between the glass substrate 10 and frame body 12, the electrode unit 3 can be held in the vacuum chamber 5 with a simpler construction.

The light-emitting apparatus 1 can be further simplified by allowing at least one of the multiple legs 30 to serve doubly as an electrically conductive line for the cathode electrode 6.

Moreover, both improvement in the durability of the light-emitting apparatus 1 and enhancement in brightness thereof with an inexpensive and simple construction can be accomplished by installing the glass substrate 51 which opposes, through a vacuum layer, the glass substrate 11 used as a light projection plane, in the vacuum chamber 5, also constituting this glass substrate 51 from a heat resistant glass material, and then mounting the anode electrode 8 on the glass substrate 51.

It is through installing a heat resistant glass substrate 51 in the vacuum chamber 5, by installing the anode electrode 8 (and fluorescent material 20) on the glass substrate 51, and separating the glass substrate 51 through a vacuum layer from the glass substrate 11 that even when the current density between the cathode electrode 6 and the anode electrode 8 is controlled at a high level to bring the light emitter 20 to emit light at high brightness, the vacuum chamber 5 can be precisely protected from thermal damage due to light emission upon excitation. Accordingly, this eliminates the need to make the entire vacuum chamber 5 excessively heat-resistant, thereby permitting it to be constructed from an inexpensive material such as soda-lime glass; consequently both improvements in the durability of the light-emitting apparatus 1 and enhancement in brightness thereof can be accomplished with an inexpensive and easy construction.

Figure 6:
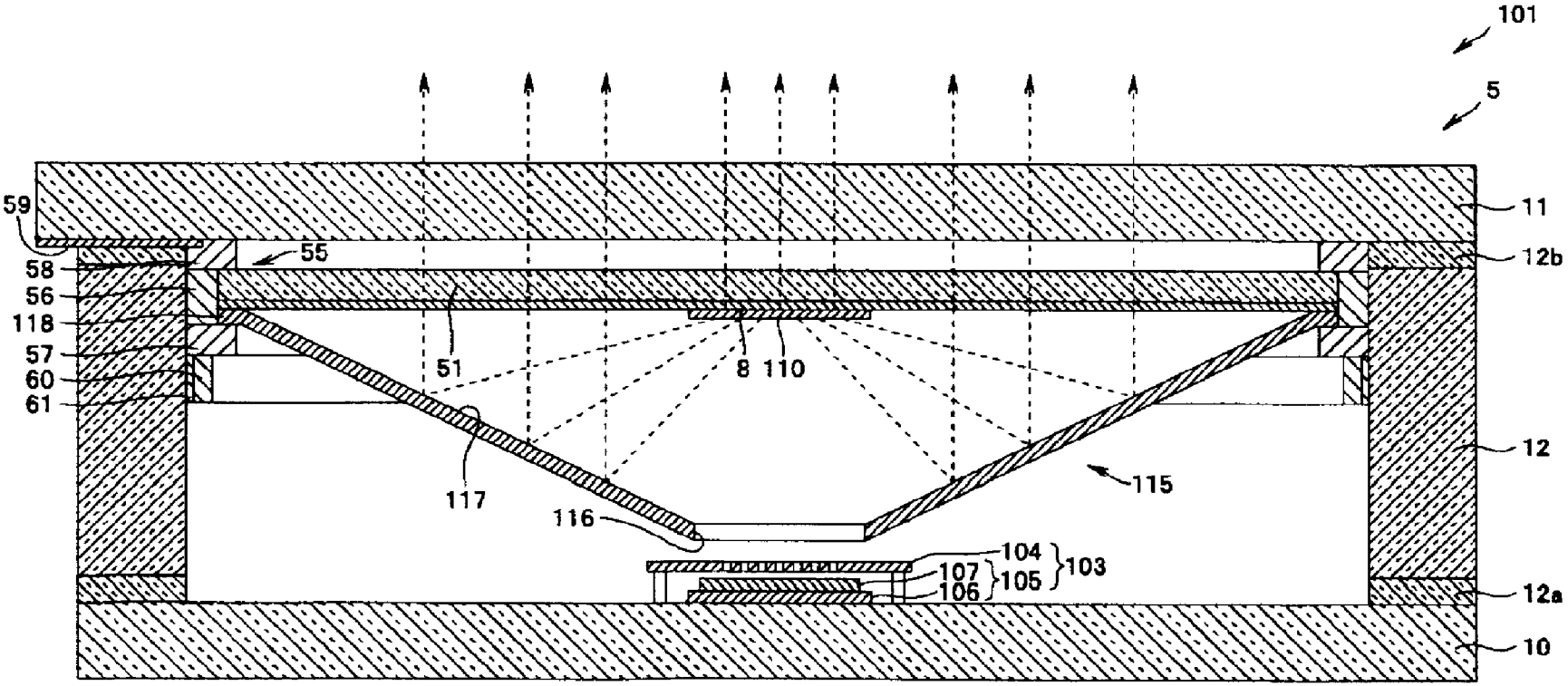
FIG. 6 is a cross-sectional view of the principal parts of a light-emitting apparatus related to a second embodiment of the present invention.
Figure 7:
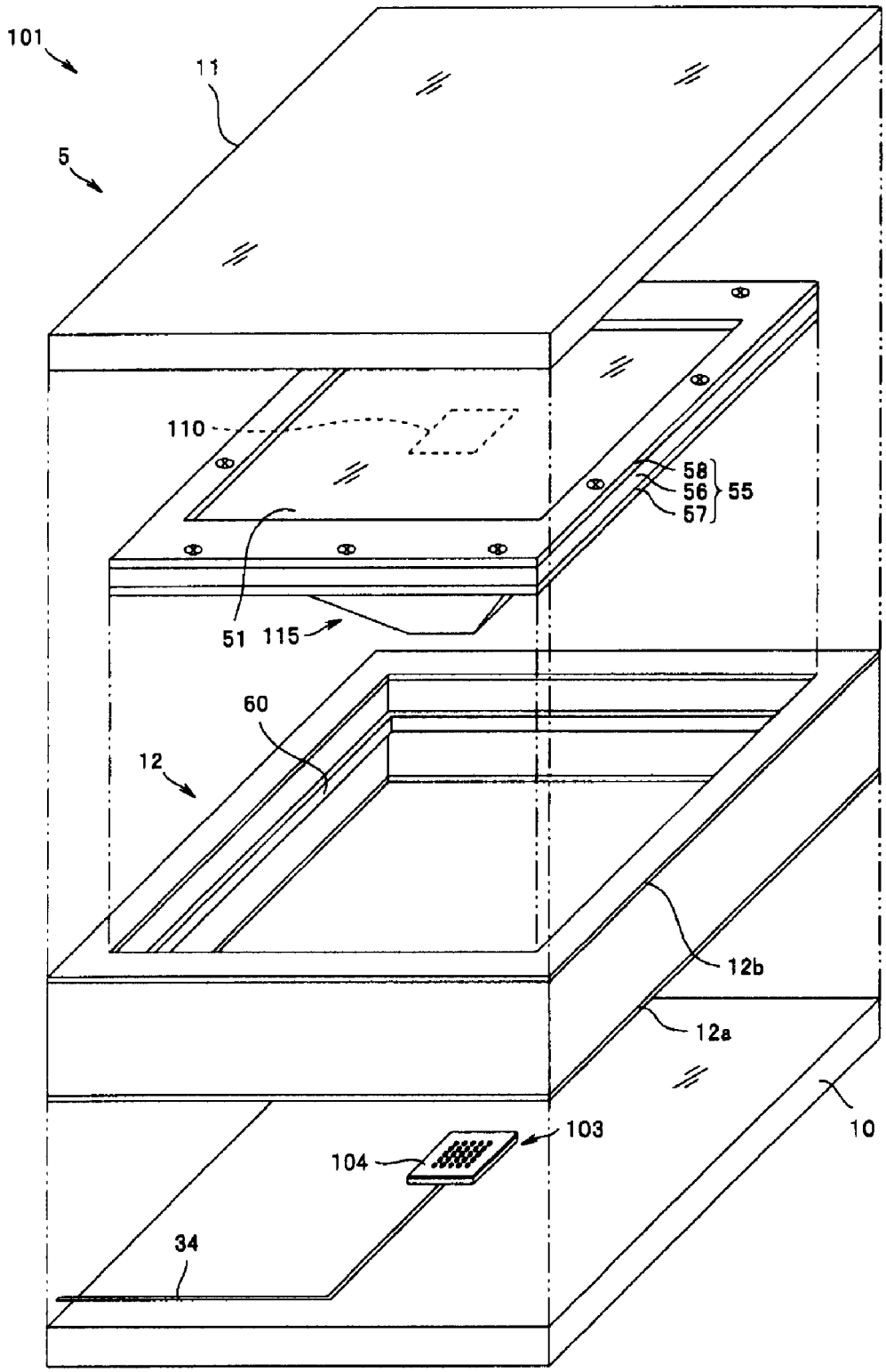
FIG. 7 is an exploded perspective view of a light-emitting apparatus related to the second embodiment of the present invention.
Figure 8:
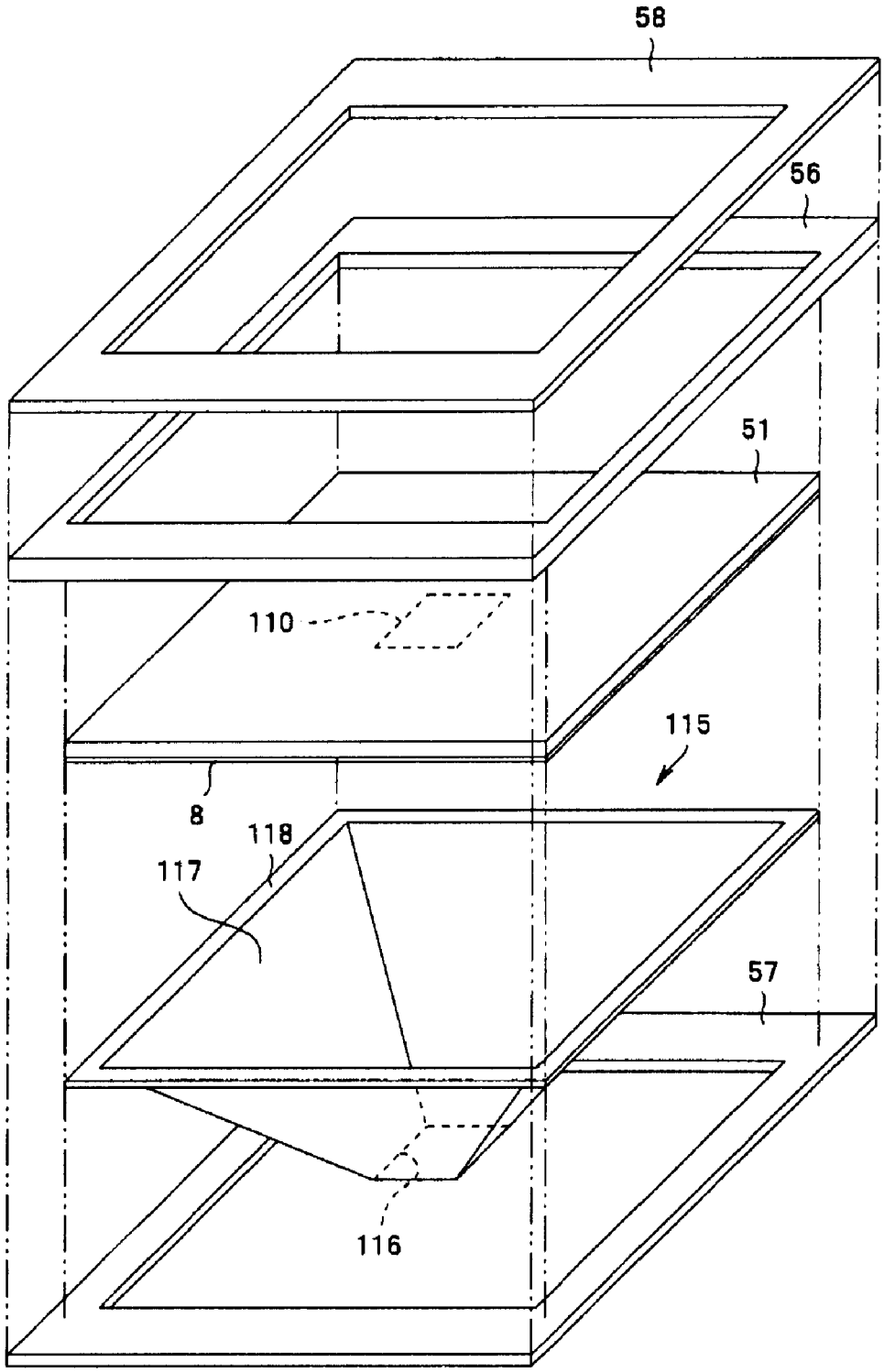
FIG. 8 is an exploded perspective view of a glass substrate and reflector unitized with a clamping fixture related to the second embodiment of the present invention.
Figure 9:
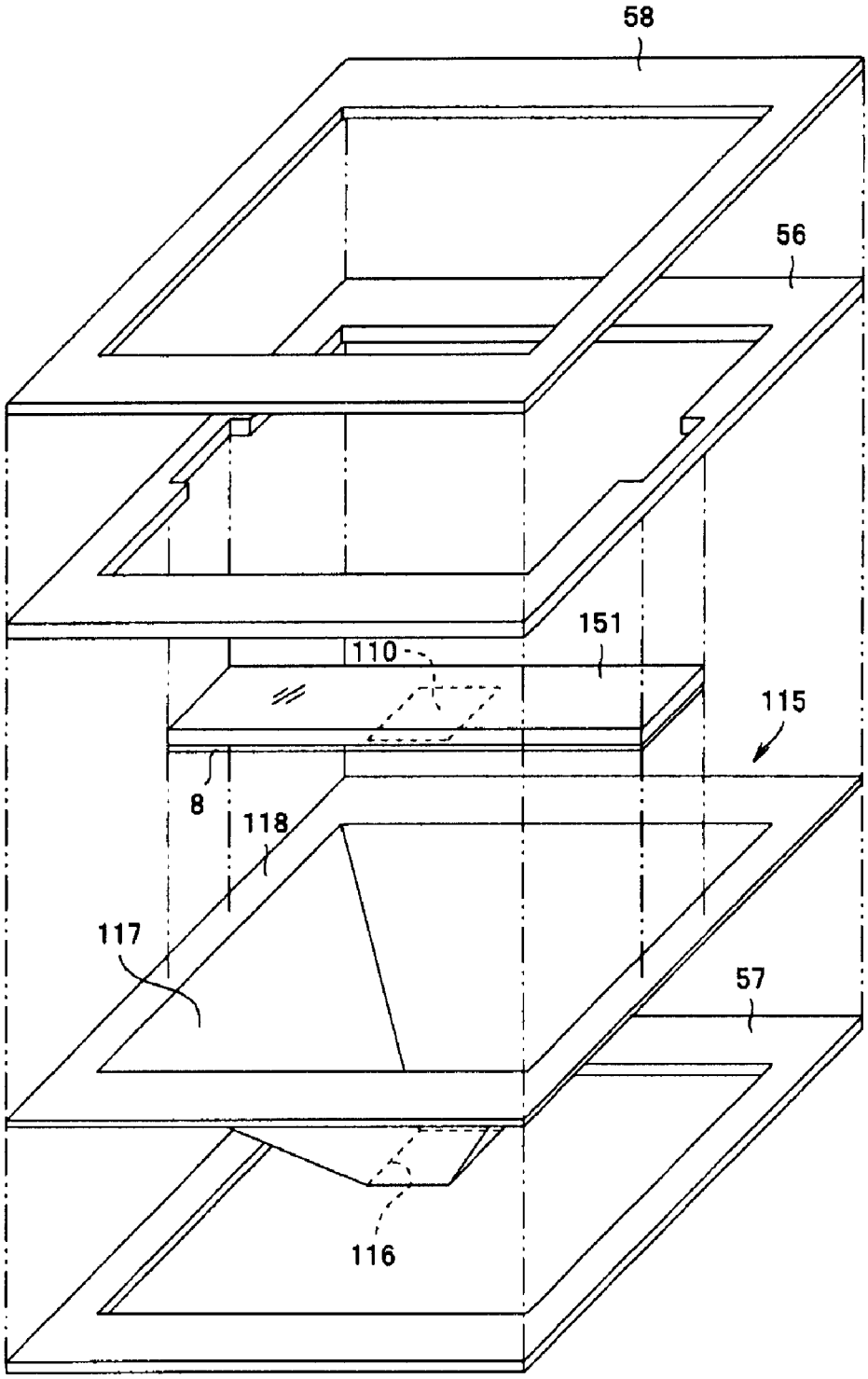
FIG. 9 is an exploded perspective view of a variant example for the glass substrate of FIG. 8, related to the second embodiment of the present invention.

Next, FIGS. 6 to 9 relate to a second embodiment of the present invention; FIG. 6 is a cross-sectional view of the principal parts of a light-emitting apparatus; FIG. 7 is an exploded perspective view of a light-emitting apparatus; FIG. 8 is an exploded perspective view of glass substrates and a reflector unitized with a clamping fixture; and FIG. 9 is an exploded perspective view of a variant example of the glass substrate in FIG. 8. The present embodiment differs mainly from the above-mentioned first embodiment in that the cathode electrode is mounted directly on the glass substrate of the base bottom face side of the vacuum chamber and a reflector is mounted between the cathode electrode and the anode electrode. For other aspects, no description is provided other than designating with like reference numbers the constituents thereof that are similar to that of the above first embodiment.

As shown in FIGS. 6 and 7, in the light-emitting apparatus 101 of the present embodiment, the electrode unit 103 consists of a cathode electrode 105 and a gate electrode 104 which has multiple apertures. Also, the cathode electrode 105 has a cold cathode electron emission source 107 formed on an electrically conductive film 106 which is formed, for example, on the glass substrate 10, thereby constituting the principal parts of the configuration.

The electrically conductive film 106 is formed by depositing metals, such as aluminum nickel and the like by vapor deposition, sputtering, or the like, or by applying a silver paste material followed by drying and firing, and the like. The cold cathode electron emission source 107 is formed by having, for example, the upper layer of the electrically conductive film 106 coated with a film of an emitter material such as carbon nano tubes, carbon nano walls, Spindt microcones, metal oxide whiskers, or the like. In the present embodiment, the electrically conductive film 106 and the cold cathode electron emission source 107 are formed in a comparatively small domain set up at an approximately central part on the glass substrate 10. In addition, as shown in FIG. 7, the pattern wiring 34 is electrically connected to the electrically conductive film 106.

On the other hand, there is formed a transparent electrically conductive film (ITO and the like) which constitutes the anode electrode 8 on the glass substrate 51 at its entire face of the side opposing the cathode electrode 105; a fluorescent material 110 is formed on the upper layer of the anode electrode 8 in the domain diametrically opposing the cold cathode electron emission source 107. In the present embodiment, the anode electrode 8 does not necessarily need to be formed entirely over the glass substrate 51; it is acceptable so long as the electrode is at least formed in a domain opposing the cold cathode electron emission source 107 and is electrically connected to the clamping fixture 55.

Moreover, a reflector 115 is intervened between the mutually opposing cathode electrode 105 and anode electrode 8 (light emitter 110). The reflector 115 is, for example, made of an electrically conductive metal member, and has at an approximately central part thereof an aperture 116 opposing an effective domain (namely, light emitter 110) of the cathode electrode 105 and the anode electrode 8 (refer to FIG. 6). Moreover, there is formed around the periphery of the aperture 116 a tapered reflector face 117 which with an aperture 116 as its base bottom, is flared towards the glass substrate 51 side; in addition, an outward flange 118 is formed at the exterior periphery of the reflector face 117. The outward flange 118, as fitted and held in the interior periphery of the fixture body 56 along with the glass substrate 51, is sandwiched between the spacers 57 and 58, whereby the reflector 115, as integrated with the glass substrate 51, is held via the clamp fixture 55 in the vacuum chamber. And the reflector 115 reflects the light emitted from the light emitter to the glass substrate side on the reflector face 117, thereby guiding it to the light projection plane (glass substrate 11). In addition, since the reflector 115 is electrically conductive, the anode electrode 8 is ensured to be electrically connected to the pattern wiring 59 through the clamp fixture 55 even when the reflector 115 is intervened between spacers 57 and 58.

Such an embodiment can markedly enhance the utilization efficiency of the light released from the light emitter 110 by reflecting, with the reflector 115, the light which is directed to the base bottom side (glass substrate 10 side) of the vacuum chamber 5 from the light emitter 110 thereby guiding the light to the light projecting plane side (glass substrate 11 side). On the other hand, with such a construction where the reflector 115 is allowed to intervene, the domain capable of forming the light emitter 110 is limited to a small size domain such that in order to assure a sufficient amount of light emission with such a small light emitter 110, it is necessary to control the current density between the cathode electrode 105 and the anode electrode 8 to be at a high level, which is postulated to cause the domain corresponding to the light emitter 110 to reach an extremely high temperature. However, as with the above-mentioned first embodiment, the light emitter 110 of the present embodiment is installed on a heat-resistant glass substrate 51 which opposes the glass substrate 11 through a vacuum layer, whereby the light-emitting apparatus 1 can provide high brightness with an inexpensive and simple construction without subjecting the vacuum chamber 5 to thermal damage.

Here, for example, as shown in FIG. 9, in the present embodiment, it is also possible to replace the glass substrate 51 which opposes approximately the entire region of the reflector 115, with a rectangular glass substrate 151 of about the same width as that of the light emitter 110. Such a construction, if implemented, can reduce the amount used of an expensive heat resistant glass such as quartz glass or the like, so that a light emitter can be constructed at lower cost. Further, much of the light reflected by the reflector face will be directly incident on the glass substrate 11, without passing through the glass substrate 151, thereby reducing the loss of light in the glass substrate 151 and further enhancing the utilization efficiency of the light released from the light emitter 110.

It is unnecessary to mention here that the application of the light-emitting apparatus 1 and light-emitting apparatus 101 of the present invention is not limited to vehicular head lamps, tail lamps, and the like, but also can also be extended to various illumination devices and the like.

What is claimed is:

1. A light-emitting apparatus comprising a cathode electrode having a cold-cathode electron emission source and an anode electrode having a light emitter which emits light upon excitation by electrons field-emitted from said cold-cathode emission source, which are housed in a vacuum chamber, wherein a quartz glass substrate made from quartz glass is mounted via a clamping fixture, oppositely to an interior face of a light projection glass substrate which constitutes a light projection plane for said vacuum chamber wherein said clamping fixture holds a periphery of said quartz glass substrate and extends to and is affixed to non-light projection plane sides of said vacuum chamber, in a manner which separates the quartz glass substrate from the light projection glass substrate by forming a separate vacuum layer in-between, and wherein said anode electrode is mounted on said quartz glass substrate, at a side facing said cathode electrode.

2. The light-emitting apparatus according to claim 1, further characterized by a reflector which intervenes between the mutually opposing cathode electrode and the anode electrode, wherein the reflector is provided with an aperture open to an opposing region of the cathode electrode and the anode electrode and with a reflecting face that reflects the light which is emitted from the light emitter and guides it to the light projection plane.

* * * * *